US011417181B2

(12) United States Patent
Nallaperumal et al.

(10) Patent No.: US 11,417,181 B2
(45) Date of Patent: Aug. 16, 2022

(54) NON-CONTACT SENSOR FOR SECURITY SYSTEMS

(71) Applicant: Carrier Corporation, Palm Beach Gardens, FL (US)

(72) Inventors: Pirammanayagam Nallaperumal, Telangana (IN); Vijayakumar Ummadisinghu, Telangana (IN); Michael Ramoutar, Westford, MA (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/252,750

(22) PCT Filed: Oct. 10, 2019

(86) PCT No.: PCT/US2019/055542
§ 371 (c)(1),
(2) Date: Dec. 16, 2020

(87) PCT Pub. No.: WO2020/086281
PCT Pub. Date: Apr. 30, 2020

(65) Prior Publication Data

US 2021/0256822 A1 Aug. 19, 2021

(30) Foreign Application Priority Data

Oct. 25, 2018 (IN) ..... 201811040292

(51) Int. Cl.
*G08B 13/08* (2006.01)

(52) U.S. Cl.
CPC ..... *G08B 13/08* (2013.01)

(58) Field of Classification Search
CPC ..... G08B 13/08; G08B 21/00
See application file for complete search history.

(56) References Cited

U.S. PATENT DOCUMENTS 6,724,316 B2 * 4/2004 Addy ..... G08B 13/08 340/539.1
7,132,941 B2 11/2006 Sherlock
8,111,383 B1 2/2012 Foley
8,149,118 B2 4/2012 Niesen et al.
8,384,538 B2 2/2013 Breed
(Continued)

FOREIGN PATENT DOCUMENTS

DE 102015119613 A1 5/2017
EP 3101444 A 12/2016

OTHER PUBLICATIONS

Amin, M. "Radar for Indoor Monitoring: Detection, Classification, and Assessment", CRC Press, Published Sep. 14, 2017, Retrieved from https://www.crcpress.com/RadarforInDoorMonitoringDetectionLocalizationandAssessment/Amin/p/book/9781138746091, Abstract Only, 2 Pages.

(Continued)

*Primary Examiner* — Toan N Pham
(74) *Attorney, Agent, or Firm* — Cantor Colburn LLP

(57) ABSTRACT

A security system includes a sensor configured to detect a distance to an object along a direction in an area; an alarm panel in communication with the sensor; at least one of the sensor and the alarm panel configured to determine a state of the object in response to the distance to the object along the direction.

16 Claims, 7 Drawing Sheets

(56) References Cited

U.S. PATENT DOCUMENTS

| | | | | |
|---|---|---|---|---|
| 8,436,628 | B2 | 5/2013 | Uhov et al. | |
| 8,773,263 | B2 * | 7/2014 | Thibault | G08B 29/22 340/545.1 |
| 9,665,778 | B1 | 5/2017 | Trundle | |
| 9,896,876 | B2 | 2/2018 | Scheiermann et al. | |
| 10,223,880 | B2 * | 3/2019 | Lamb | G08B 29/185 |
| 10,460,582 | B2 * | 10/2019 | Anderholm | G08B 13/19613 |
| 10,565,843 | B2 * | 2/2020 | Hunt | G08B 21/22 |
| 10,692,340 | B2 * | 6/2020 | Seelman | G08B 29/188 |
| 2009/0058711 | A1 | 3/2009 | Dixon et al. | |
| 2015/0027057 | A1 | 1/2015 | Britt, Jr. et al. | |
| 2016/0054148 | A1 | 2/2016 | Misfatto | |
| 2016/0189527 | A1 | 6/2016 | Peterson et al. | |
| 2017/0356238 | A1 | 12/2017 | Gitman | |
| 2018/0031604 | A1 | 2/2018 | Chennakeshu et al. | |

OTHER PUBLICATIONS

Chang, S. et al. "UWB radar-based human target tracking", IEEE Radar Conference, May 4-8, 2009, Retrrieved from https://ieeexplore.ieee.org/document/4977001, Abstract Only, 1 Page.

Diraco, G. et al. "A Radar-Based Smart Sensor for Unobstrusive Elederly Monitoring in Ambient Assisted Living Applications.", Biosensors (Basel). Nov. 24, 2017;7(4), Abstract Only, 2 Pages.

International Search Report dated Feb. 4, 2020; International Application No. PCT/US2019/055542; International Filing Date Oct. 10, 2019 (6 pgs).

Written Opinion dated Feb. 4, 2020; International Application No. PCT/US2019/055542; International Filing Date Oct. 10, 2019 (8 pgs).

* cited by examiner

| Virtual Sensor ID | Object ID | Direction | State1 | State2 | State3 |
|---|---|---|---|---|---|
| Sensor1 | door1 | x1, y1, z1 | 14m | 8m | 9m |
| Sensor2 | window1 | x2, y2, z2 | 12m | 11m | 11.5m |
| | | | | | |
| | | | | | |

FIG. 7

NON-CONTACT SENSOR FOR SECURITY SYSTEMS

BACKGROUND

The embodiments described herein relate generally to sensors for security systems, and more particularly to non-contact sensors for a security system.

Contact sensors are used to detect the opening/closing of doors, windows, lockers, etc. Contact sensors are numerous in home security systems as users would like to know the state of every door/window of their home. The state of the doors/windows are used by automation systems to control light, cooling systems, etc. These numerous contact sensors are costly and cumbersome to install.

SUMMARY

According to an embodiment, a security system includes a sensor configured to detect a distance to an object along a direction in an area; an alarm panel in communication with the sensor; at least one of the sensor and the alarm panel configured to determine a state of the object in response to the distance to the object along the direction.

In addition to one or more of the features described herein, or as an alternative, further embodiments of the system may include wherein the alarm panel is configured to generate an alert in response to the state of the object.

In addition to one or more of the features described herein, or as an alternative, further embodiments of the system may include wherein at least one of the sensor and the alarm panel stores provisioning data for each object in the area.

In addition to one or more of the features described herein, or as an alternative, further embodiments of the system may include wherein the provisioning data includes an object identifier, a distance to the object, a direction to the object and state data for the object.

In addition to one or more of the features described herein, or as an alternative, further embodiments of the system may include wherein the state data comprises a first state and a first distance corresponding to the first state and a second state and a second distance corresponding to the second state.

In addition to one or more of the features described herein, or as an alternative, further embodiments of the system may include wherein at least one of the sensor and the alarm panel is configured to transmit an alert message over a network in response to the state of the object.

In addition to one or more of the features described herein, or as an alternative, further embodiments of the system may include wherein the object is a door and the state is at least one of open, closed and partially open.

According to another embodiment, a method includes detecting a distance to an object along a direction in an area; receiving the distance to the object along the direction; determining a state of the object in response to the distance to the object along the direction.

In addition to one or more of the features described herein, or as an alternative, further embodiments of the method may include generating an alert in response to the state of the object.

In addition to one or more of the features described herein, or as an alternative, further embodiments of the system may include storing provisioning data for each object in the area.

In addition to one or more of the features described herein, or as an alternative, further embodiments of the system may include wherein the provisioning data includes an object identifier, a direction to the object and state data for the object.

In addition to one or more of the features described herein, or as an alternative, further embodiments of the system may include wherein the state data comprises a first state and a first distance corresponding to the first state and a second state and a second distance corresponding to the second state.

In addition to one or more of the features described herein, or as an alternative, further embodiments of the system may include transmitting a message in response to the state of the object.

In addition to one or more of the features described herein, or as an alternative, further embodiments of the system may include wherein the object is a door and the state is at least one of open, closed and partially open.

According to another embodiment, a computer program product, tangibly embodied on a computer readable medium, the computer program product including instructions that, when executed by a processor, cause the processor to perform operations including receiving a distance to an object along a direction in an area; determining a state of the object in response to the distance to the object along the direction.

Technical effects of embodiments of the present disclosure include the ability of detect states of objects, such as doors, windows, lockers, etc., with non-contact sensors. The state of an object may be used to generate alerts by an alarm panel.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

FIG. 7 depicts provisioning data for a security system in an example embodiment.

DETAILED DESCRIPTION

Figure 1:
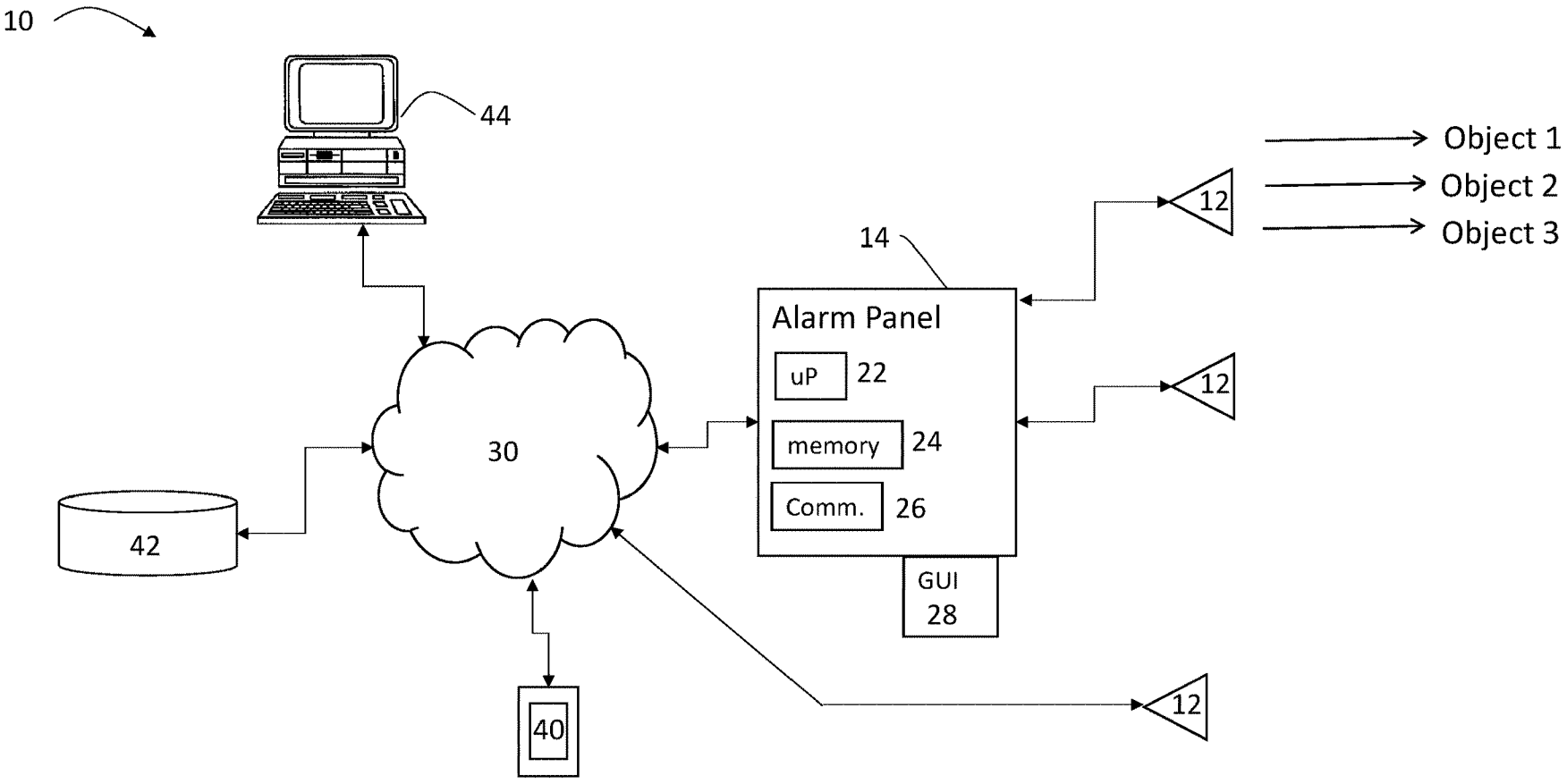
FIG. 1 depicts a security system in an example embodiment.

FIG. 1 is depicts a security system 10 in an example embodiment. The security system 10 includes a plurality of sensors 12 that detect the status of objects in an area, such as doors and windows. The sensors 12 are non-contact sensors and provide data points to an alarm panel 14. The sensors 12 may be connected to the alarm panel 14 using wired or wireless techniques, as known in the art. The sensors 12 may be connected to a network 30 using wired or wireless techniques, as known in the art. Each sensor 12 may detect multiple objects in an area. The sensors 12 can have the capability of acting in a default configuration as a single sensor or may operate as multiple sensors depending on the number of objects the sensor is configured to monitor.

The alarm panel 14 may include a processor 22, memory 24 and communication module 26 as shown in FIG. 1. The processor 22 can be any type or combination of computer processors, such as a microprocessor, microcontroller, digital signal processor, application specific integrated circuit, programmable logic device, and/or field programmable gate array. The memory 24 is an example of a non-transitory computer readable storage medium tangibly embodied in the alarm panel 14 including executable instructions stored therein, for instance, as firmware. The communication module 26 may implement one or more communication protocols as described in further detail herein.

As noted above, the alarm panel 14 communicates with the sensors 12 to obtain data points from the sensors 12. Communication between the alarm panel 14 and the sensors 12 may be performed using relatively short range communication, including wireless protocols (e.g., 802.xx, Zigbee, BTLE, PAN, etc.), wired protocols (e,g., LAN, power line communication, etc.) or a combination of wired and wireless protocols.

The alarm panel 14 includes a GUI 28 that allows a user to access the status of objects monitored by the sensors 12. The objects are typically fixed in location and have multiple states. For example, the objects may include doors and windows in a home and the various states may include open, closed and partially open. Through the GUI 28, a user can see the state of the objects monitored by sensors 12.

The alarm panel 14 also communicates with a variety of other devices over network 30. A mobile device 40 may communicate with the alarm panel 14 over the network 30 so that a user can remotely access the status of objects monitored by the sensors 12. A remote data center 42 communicates with the alarm panel 14 and may store data periodically collected by the alarm panel 14 to archive the data. A remote terminal 44 may communicate with the alarm panel 14 over the network 30 and receive alerts generated by the alarm panel 14. The remote terminal 44 may be associated with a monitoring service or a responder (e.g., police/fire). The mobile device 40, remote data center 42 and/or the remote terminal 44 may also directly communicate with one or sensors 12 over network 30.

The network 30 may be implemented via one or more networks, such as, but are not limited to, one or more of WiMax, a Local Area Network (LAN), Wireless Local Area Network (WLAN), a Personal area network (PAN), a Campus area network (CAN), a Metropolitan area network (MAN), a Wide area network (WAN), a Wireless wide area network (WWAN), or any broadband network, and further enabled with technologies such as, by way of example, Global System for Mobile Communications (GSM), Personal Communications Service (PCS), Bluetooth, WiFi, Fixed Wireless Data, 2G, 2.5G, 3G (e.g., WCDMA/UMTS based 3G networks), 4G, IMT-Advanced, pre-4G, LTE Advanced, mobile WiMax, WiMax 2, WirelessMAN-Advanced networks, enhanced data rates for GSM evolution (EDGE), General packet radio service (GPRS), enhanced GPRS, iBurst, UMTS, HSPDA, HSUPA, HSPA, HSPA+, UMTS-TDD, 1×RTT, EV-DO, messaging protocols such as, TCP/IP, SMS, MMS, extensible messaging and presence protocol (XMPP), real time messaging protocol (RTMP), instant messaging and presence protocol (IMPP), instant messaging, USSD, IRC, or any other wireless data networks, broadband networks, or messaging protocols.

The sensors 12 scan an area and generate data points having a direction and a distance. The sensors 12 may emit energy in a direction and detect reflection of that energy back to the sensor 12 to measure distance to an object along a certain direction. The direction may defined by three dimensional coordinates (e.g., Cartesian coordinates, spherical coordinates, cylindrical coordinates, etc.) with the sensor 12 as the origin of the coordinate system. In an embodiment, the sensors 12 are RADAR sensors that scan an area to detect a distance to an object along a direction.

Figure 2:
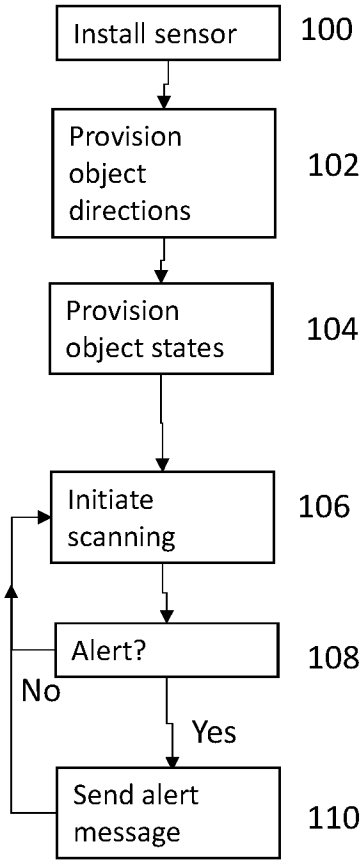
FIG. 2 depicts a process of commissioning and operating a security system in an example embodiment.
Figure 3:
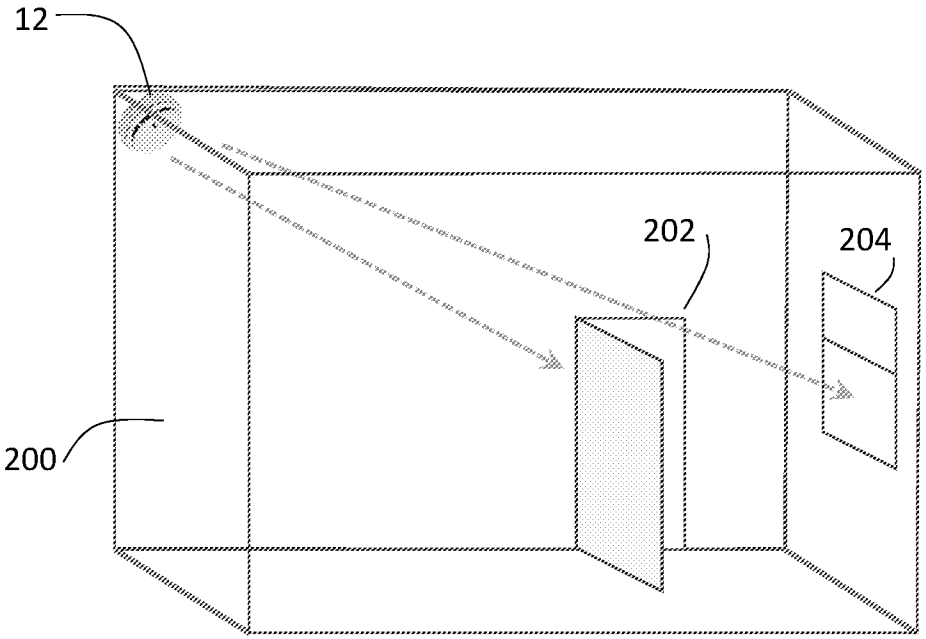
FIG. 3 depicts a commissioning a security system in an example embodiment.

FIG. 2 depicts a process of commissioning and operating the security system 10 in an example embodiment. The process of FIG. 2 is described with reference to a single sensor 12, but it is understood that the same process may be applied to a plurality of sensors. At 100, the sensor 12 is installed in an area to be monitored. At 102, the direction to each object to be monitored is provisioned. Each object is identified with an object identifier. FIG. 3 depicts an area 200 (e.g., a room) having a first object 202 (e.g., a door) and a second object 204 (e.g., a window). The direction is identified as a direction in a three dimensional coordinate system, which may use the sensor 12 as the origin. An object identifier is then associated with a direction. In the example in FIG. 3, door 202 may be assigned an object identifier (e.g., door1) and a direction from the sensor 12 where the door 202 is located. An object identifier (e.g., window1) and a direction from the sensor 12 would be stored for window 204. The object identifiers and directions may be stored in the memory 24 of the alarm panel 14 or the sensor 12.

Figure 4:
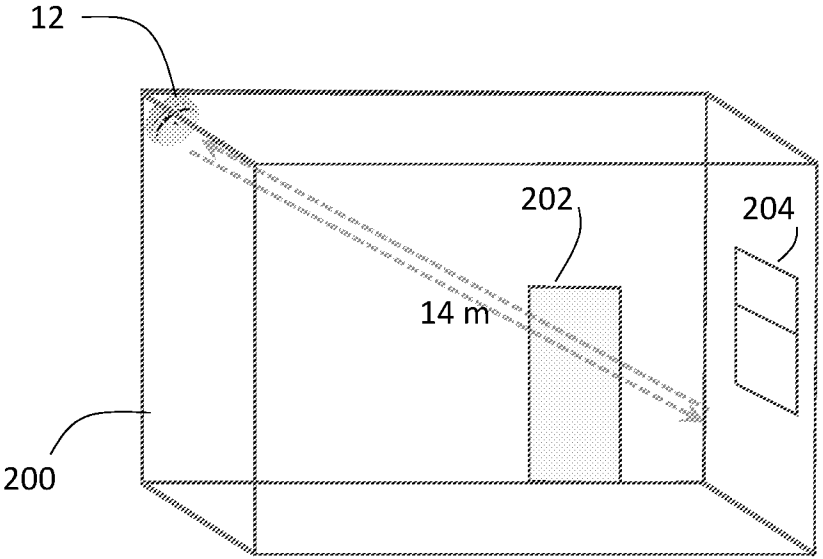
FIGS. 4-6 depict operating a security system in an example embodiment.
Figure 5:
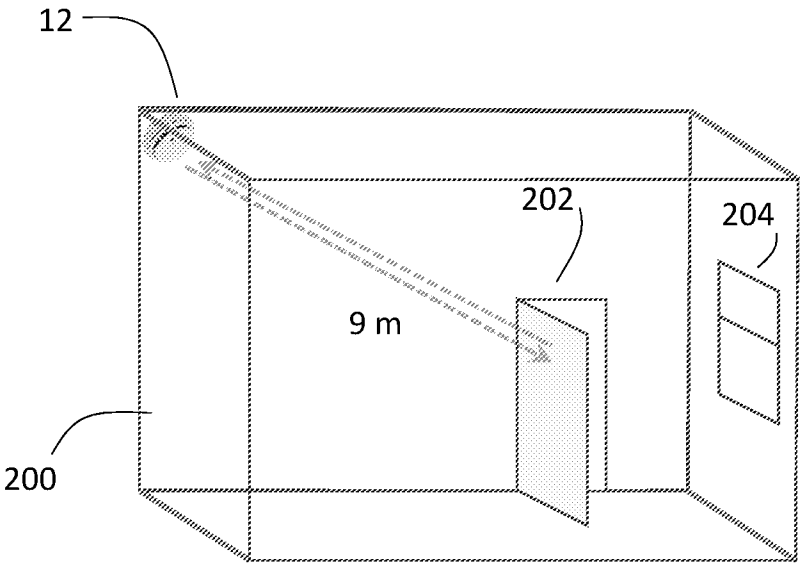
Figure 6:
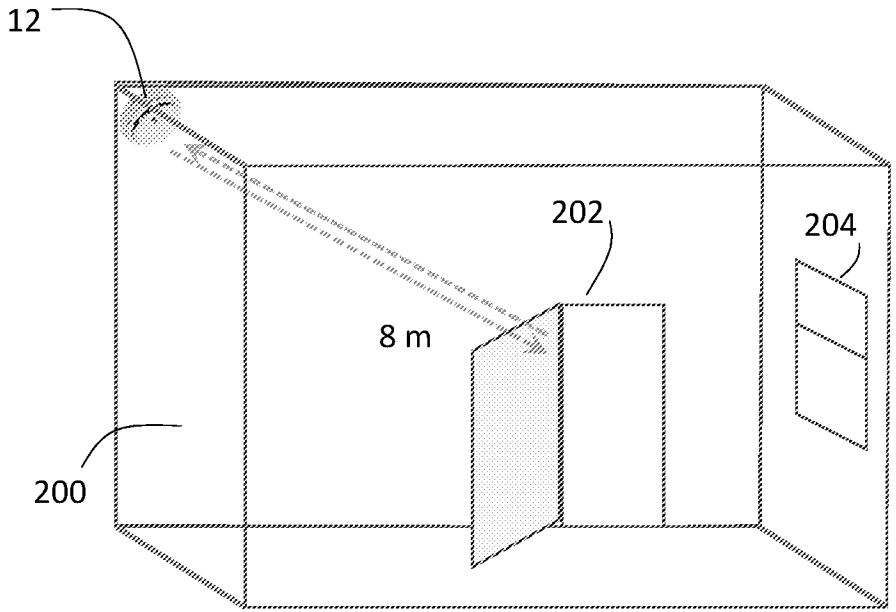

Referring back to FIG. 2, at 104 states of the objects are provisioned. For example, with respect to the example in FIG. 3, the distance along the direction associated with door 202 may be mapped to certain door states. For example, when the door 202 is in a first state (e.g., closed), the distance along the direction associated with door 202 may be at a first, maximum value (e.g., 14 m) as shown in FIG. 4, as the door is not blocking the beam emitted by the sensor 12. When the door 202 is in a second state (e.g., partially open), the distance along the direction associated with door 202 may be at a second, moderate value (e.g., 9 m) as shown in FIG. 5. When the door 202 is in a third state (e.g., fully open), the distance along the direction associated with door 202 may be a third, minimum value (e.g., 8 m) as shown in FIG. 6. In a similar manner, distances along the direction to the window 204 may be provisioned to define states of the window 204 (e.g., open, closed, partially open).

The state information collected at 104 may be stored in the memory 24 of the alarm panel 14 or the sensor 12. FIG. 7 depicts example provisioning data. The provisioning data includes a virtual sensor identifier, an object identifier, the direction from the sensor 12 associated with the object, and a plurality of state identifiers. The state identifiers in the example in FIG. 7 correspond to the door states in FIGS. 4-6.

Referring back to FIG. 2, once the object data and state data is provisioned, flow proceeds to 106 where the security system 10 enters an operational mode and initiates scanning the area 200 to determine current distance to one or more objects. The scanning may occur over the entire coordinate system corresponding of the area 200 or only along the directions provisioned at 102. The scanning may be in real-time (e.g., continuous) or occur periodically (e.g., once every 10 seconds). As noted above, the scanning entails the sensor 12 emitting energy along a direction and determining the distance to an object along that direction. This creates a data point having a direction and distance.

At 108, the alarm panel 14 uses the data points from the sensor 12 to determine if an alert should be generated. For example, the data point may indicate that the door 202 has been opened when it should not be (e.g., alarm system is armed). The alarm panel 14 detects that the door is open based on the distance and direction from the sensor 12 as compared to the provisioned object states. If no alert is generated at 108, the process reverts to 106. If an alert is generated at 108, flow proceeds to 110 where an message may be transmitted over network 30 to mobile device 40, remote terminal 44, etc. The message may be an alert message that notifies the mobile device 40, remote terminal 44, etc. of a n alert condition. The message may be an action message used to take actions, such as turning on lights and other home automation operations.

In an other embodiment, one or more of the sensors 12 include the provisioning data of FIG. 7 and can determine the state of one or more objects in the area 200. In these embodiments, the sensor 12 communicates the state of the object to the alarm panel 14, which can then generate an alert if needed. For example, the alarm panel 14 may receive the state of the door 202 (e.g., open) from the sensor 12, and determine that this state initiates an alert (e.g., system is armed). The state of the object from the sensor 12 may also be communicated to the mobile device 40, the remote data center 42 and/or the remote terminal 44 over the network 30.

Embodiments provide an alarm system that uses non-contact sensors to determine the state of an object. The state of the object may then be used to generate alerts. One advantage of embodiments is low installation cost and time for the security system as compared to systems requiring individual contact sensors at each object. The installation cost does not increase with the number of objects (e.g., doors and windows) in the home.

As described above, embodiments can be in the form of processor-implemented processes and devices for practicing those processes, such as a processor in the alarm panel. Embodiments can also be in the form of a computer program product containing instructions embodied in tangible computer readable media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A security system comprising:

a sensor configured to detect a distance to an object along a direction in an area, the sensor mounted in a fixed location in the area;

an alarm panel in communication with the sensor;

at least one of the sensor and the alarm panel configured to determine a state of the object in response to the distance to the object along the direction.

2. The security system of claim 1 wherein:

the alarm panel is configured to generate an alert in response to the state of the object.

3. The security system of claim 1 wherein:

at least one of the sensor and the alarm panel stores provisioning data for each object in the area.

4. The security system of claim 3 wherein:

the provisioning data includes an object identifier, a distance to the object, a direction to the object and state data for the object.

5. The security system of claim 4 wherein:

the state data comprises a first state and a first distance corresponding to the first state and a second state and a second distance corresponding to the second state.

6. The security system of claim 1 wherein:

at least one of the sensor and the alarm panel is configured to transmit an alert message over a network in response to the state of the object.

7. The security system of claim 1 wherein:

the object is a door and the state is at least one of open, closed and partially open.

8. A method comprising:

detecting a distance to an object along a direction in an area using a sensor mounted in a fixed location in the area;

receiving the distance to the object along the direction;

determining a state of the object in response to the distance to the object along the direction.

9. The method of claim 8 further comprising:

generating an alert in response to the state of the object.

10. The method of claim 8 further comprising:

storing provisioning data for each object in the area.

11. The method of claim 10 wherein:

the provisioning data includes an object identifier, a direction to the object and state data for the object.

12. The method of claim 11 wherein:

the state data comprises a first state and a first distance corresponding to the first state and a second state and a second distance corresponding to the second state.

13. The method of claim 8 further comprising:

transmitting a message in response to the state of the object.

14. The method of claim 8 wherein:

the object is a door and the state is at least one of open, closed and partially open.

15. A computer program product, tangibly embodied on a non-transitory computer readable medium, the computer program product including instructions that, when executed by a processor, cause the processor to perform operations comprising:

receiving a di stance to an object along a direction in an area from a sensor mounted in a fixed location in the area;

determining a state of the object in response to the distance to the object along the direction.

16. A security system comprising:

a sensor configured to detect a distance to each one of a plurality of objects in an area;

an alarm panel in communication with the sensor;

at least one of the sensor and the alarm panel configured to determine a state of each of the plurality of objects in response to distance to the object.

* * * * *